US007980037B2

(12) United States Patent
Trabue et al.

(10) Patent No.: US 7,980,037 B2
(45) Date of Patent: Jul. 19, 2011

(54) DECORATIVE WALL COVERING WITH IMPROVED INTERLOCK SYSTEM

(75) Inventors: Robert Trabue, Hollywood, FL (US); Stefan Schwarz, Coral Springs, FL (US)

(73) Assignee: Exteria Building Products, LLC, Miami, FL (US)

( * ) Notice: Subject to any disclaimer, the term of this patent is extended or adjusted under 35 U.S.C. 154(b) by 299 days.

(21) Appl. No.: 11/588,540

(22) Filed: Oct. 27, 2006

(65) Prior Publication Data

US 2008/0098683 A1 May 1, 2008

(51) Int. Cl.
*E04D 1/00* (2006.01)
*E04F 17/00* (2006.01)

(52) U.S. Cl. ..... 52/522; 52/302.1; 52/533; 52/539

(58) Field of Classification Search ..... 52/302.1, 52/302.3, 519, 520, 521, 522, 533, 539
See application file for complete search history.

(56) References Cited

U.S. PATENT DOCUMENTS

| | | | | | |
|---|---|---|---|---|---|
| 130,156 | A | * | 8/1872 | Roux et al. | 52/536 |
| 1,124,001 | A | * | 1/1915 | Elzey | 52/533 |
| 1,559,967 | A | * | 11/1925 | King | 52/522 |
| 1,572,377 | A | * | 2/1926 | Blair | 52/553 |
| 2,659,323 | A | * | 11/1953 | Alvarez, Jr. | 52/302.1 |
| 2,766,706 | A | * | 10/1956 | Ludowici | 52/533 |
| 2,766,861 | A | * | 10/1956 | Abramson | 52/531 |
| 2,811,118 | A | * | 10/1957 | Ball | 52/534 |
| 3,158,960 | A | * | 12/1964 | Newton et al. | 52/302.1 |
| 3,188,774 | A | * | 6/1965 | McCorkle | 52/478 |
| 3,214,876 | A | * | 11/1965 | Mattes | 52/520 |
| 3,233,382 | A | * | 2/1966 | Graveley, Jr. | 52/522 |
| 3,417,531 | A | * | 12/1968 | Jones | 52/520 |
| 3,613,326 | A | * | 10/1971 | Mollman | 52/314 |
| 4,102,106 | A | * | 7/1978 | Golder et al. | 52/533 |
| 4,223,490 | A | * | 9/1980 | Medow | 52/98 |
| 4,334,396 | A | * | 6/1982 | Hagopian | 52/522 |
| 4,468,909 | A | * | 9/1984 | Eaton | 52/541 |
| 4,680,911 | A | * | 7/1987 | Davis et al. | 52/521 |
| 4,731,969 | A | * | 3/1988 | Baker et al. | 52/536 |
| 5,072,562 | A | * | 12/1991 | Crick et al. | 52/533 |
| 5,074,093 | A | * | 12/1991 | Meadows | 52/537 |
| 5,076,037 | A | | 12/1991 | Crick et al. | |
| 5,249,402 | A | | 10/1993 | Crick et al. | |

(Continued)

FOREIGN PATENT DOCUMENTS

JP 04027059 A * 1/1992

*Primary Examiner* — Robert J Canfield
*Assistant Examiner* — Charissa Ahmad
(74) *Attorney, Agent, or Firm* — Drinker Biddle & Reath LLP

(57) ABSTRACT

A roof or wall covering comprising a plurality of horizontal courses of molded plastic panels each formed with a single row of simulated shake shingles. The panels have a continuous upper interlock flange that facilitates inner-engagement of the panels of overlying courses without cumbersome handling of numerous small interlock fingers which can be missed during installation. Cooperating detents are provided between the overlying lower and upper marginal edge regions which facilitate proper positioning of the panels and which support the weight of the panel during securement to a wall surface. A bottom interlock flange is supported transversely across a rear side of the panel by vertically-spaced support plates which facilitate both liquid drainage and air circulation through the installed wall covering. In the preferred embodiment, the panels in alternate courses are identically formed with different shake patterns for enhancing the natural appearance of the wall covering.

13 Claims, 4 Drawing Sheets

U.S. PATENT DOCUMENTS 5,305,570 A * 4/1994 Rodriguez et al. ..... 52/520
5,347,784 A 9/1994 Crick et al.
5,537,792 A * 7/1996 Moliere ..... 52/531
5,644,886 A * 7/1997 Ekmark et al. ..... 52/518
5,675,955 A * 10/1997 Champagne ..... 52/521
5,791,093 A * 8/1998 Diamond ..... 52/36.5
5,878,543 A * 3/1999 Mowery ..... 52/519
5,916,100 A * 6/1999 Mitchell et al. ..... 52/235
6,082,064 A * 7/2000 Mitchell et al. ..... 52/235
6,224,701 B1 * 5/2001 Bryant et al. ..... 156/73.1
6,295,777 B1 * 10/2001 Hunter et al. ..... 52/519
6,336,303 B1 * 1/2002 Vandeman et al. ..... 52/520
6,421,975 B2 * 7/2002 Bryant et al. ..... 52/528
6,490,835 B1 * 12/2002 Simmons ..... 52/554
6,526,718 B2 * 3/2003 Manning et al. ..... 52/555
6,715,250 B2 * 4/2004 Bryant et al. ..... 52/528
D507,837 S * 7/2005 King ..... D25/141
6,955,019 B2 10/2005 Donlin et al.
6,976,342 B1 * 12/2005 Kowalevich ..... 52/546
7,008,213 B2 * 3/2006 King ..... 425/326.1
7,207,145 B2 * 4/2007 Stucky et al. ..... 52/555
7,240,461 B1 * 7/2007 Vandeman et al. ..... 52/539
7,698,865 B2 * 4/2010 Pringle et al. ..... 52/520
7,739,848 B2 * 6/2010 Trout ..... 52/581
7,775,009 B2 * 8/2010 King ..... 52/520
2002/0026758 A1 * 3/2002 Mitchell ..... 52/235
2005/0072093 A1 * 4/2005 King ..... 52/522
2005/0102946 A1 * 5/2005 Stucky et al. ..... 52/518
2008/0083186 A1 * 4/2008 Gaudreau ..... 52/520

* cited by examiner

CTR. GROOVE
CTR. DETENT

DECORATIVE WALL COVERING WITH IMPROVED INTERLOCK SYSTEM

FIELD OF THE INVENTION

The present invention relates generally to roof and wall coverings which are primarily intended for outdoor usage, and more particularly, to roof and wall coverings comprised of relatively large panels which each are molded or otherwise formed with decorative patterns characteristic of conventional roofing and siding materials, such as shake shingles, tile, brick or the like.

BACKGROUND OF THE INVENTION

Various synthetic roof and wall coverings are known, such as those formed of elongated thermoplastic panels that are nailed or screwed to a wall or roof support surface in horizontal courses or rows in partially overlapping relation to each other so as to provide a substantially water resistant, protective layer over the support surface. Such panels, which usually are identically molded, are commonly formed with a plurality of rows of simulated building elements, such as shake shingles. Because the panels are relatively large, such as up to eight feet and more in length, they can be cumbersome to handle and install, particularly on vertical wall and steep roof surfaces. Since the panels are identically molded, a panel-to-panel identity also can be easily noticed if the panels are not carefully installed. Leakage problems between adjoining panels can also occur under these circumstances.

Such panels commonly are nailed to the wall or support surface in horizontal courses, beginning with the lower-most course. To enable interlocking engagement between the upper and lower marginal edge regions of vertically-adjacent panels, it is known to provide a plurality of longitudinally-spaced outwardly and downwardly directed interlocked fingers along the upper marginal edge region of the underlying panel which are engaged by a bottom rail formed on the underside of the overlying panel as an incident to upward positioning movement of the panel. Due to the size of the panels it can be difficult for the installer to engage all of the fingers with the upturned rail, with any missed fingers causing an unsightly bowing of the overlying panel, which both detracts from its appearance of the finished wall covering and makes it more susceptible to water entering the juncture between the panels.

Even when the panel is properly positioned, it can be difficult for the installer to properly hold and maintain a panel and at the same time nail or screw it to the wall surface. Because the upturned interlock rail on the overlying panel extends across a rear side of the simulated shake, even with careful molding, a transverse line of the rail can sometimes be faintly observed from a front side of the panel, which again detracts from the natural appearance of the wall covering. The upturned rail also can undesirably capture and retain water that might migrate between the panels, such as during severe weather conditions.

OBJECTS AND SUMMARY OF THE INVENTION

It is an object of the present invention to provide a wall covering comprising thermoplastic wall or roof panels which have an interlock arrangement between overlapping upper end marginal edge regions of panels that is adapted for easier and more-reliable engagement during installation.

Another object is to provide a wall or roof panel as characterized above that facilitates proper positioning of a panel into overlying relation to a previously-installed panel.

A further object is to provide a panel of the above kind which effects positive interlocking engagement of an overlying panel onto a previously-mounted panel sufficient to support the weight of the panel during securement onto the wall surface. A related object is to provide such a panel interlock arrangement that is releasable to permit adjustable positioning of the panel during installation if necessary, and to accommodate expansion and contraction of the panels from temperature changes during usage.

Yet another object is to provide a wall or roof panel of the foregoing type which has an upturned interlock rail integrally molded on a rear side of the panel that does not detract from the exterior appearance of the simulated building elements.

A further object is to provide such a wall panel in which the upturned interlock rail across the rear of the panel facilitates water drainage and air circulation through the completed wall covering.

Still another object is to provide a wall or roof panel of such type which is relatively simple in construction and which lends itself to economical molding.

Other objects and advantages of the invention will become apparent upon reading the following detailed description and upon reference to the drawings, in which:

BRIEF DESCRIPTION OF THE SEVERAL VIEWS OF THE DRAWING(S)

Figures 2, 3, 4, 5:
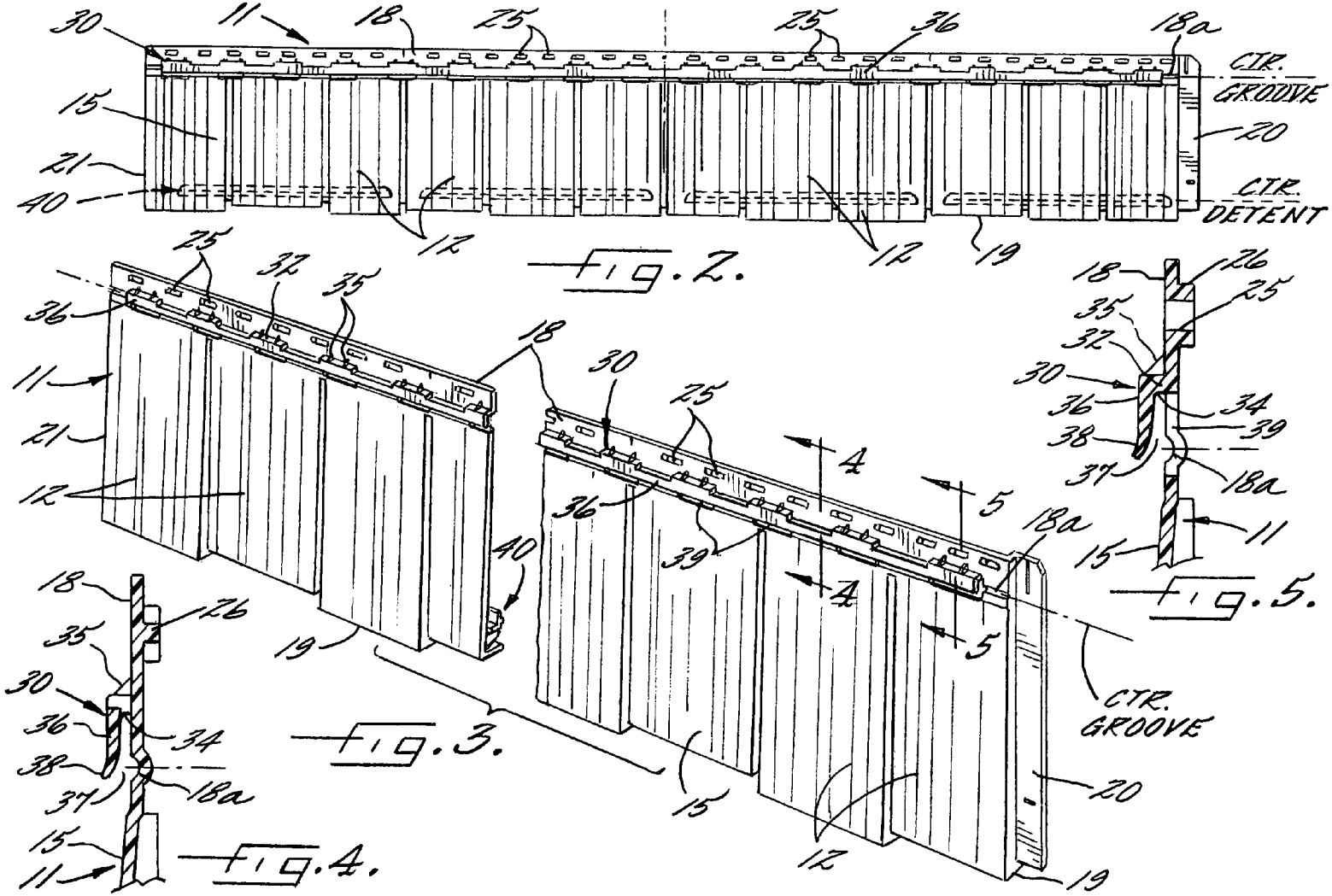
FIG. 2 is a front plan view of one of the panels of the wall covering shown in FIG. 1.
FIG. 3 is an enlarged front perspective of the panel shown in FIG. 2, with a central portion broken away.
Figures 6, 7, 8, 9:
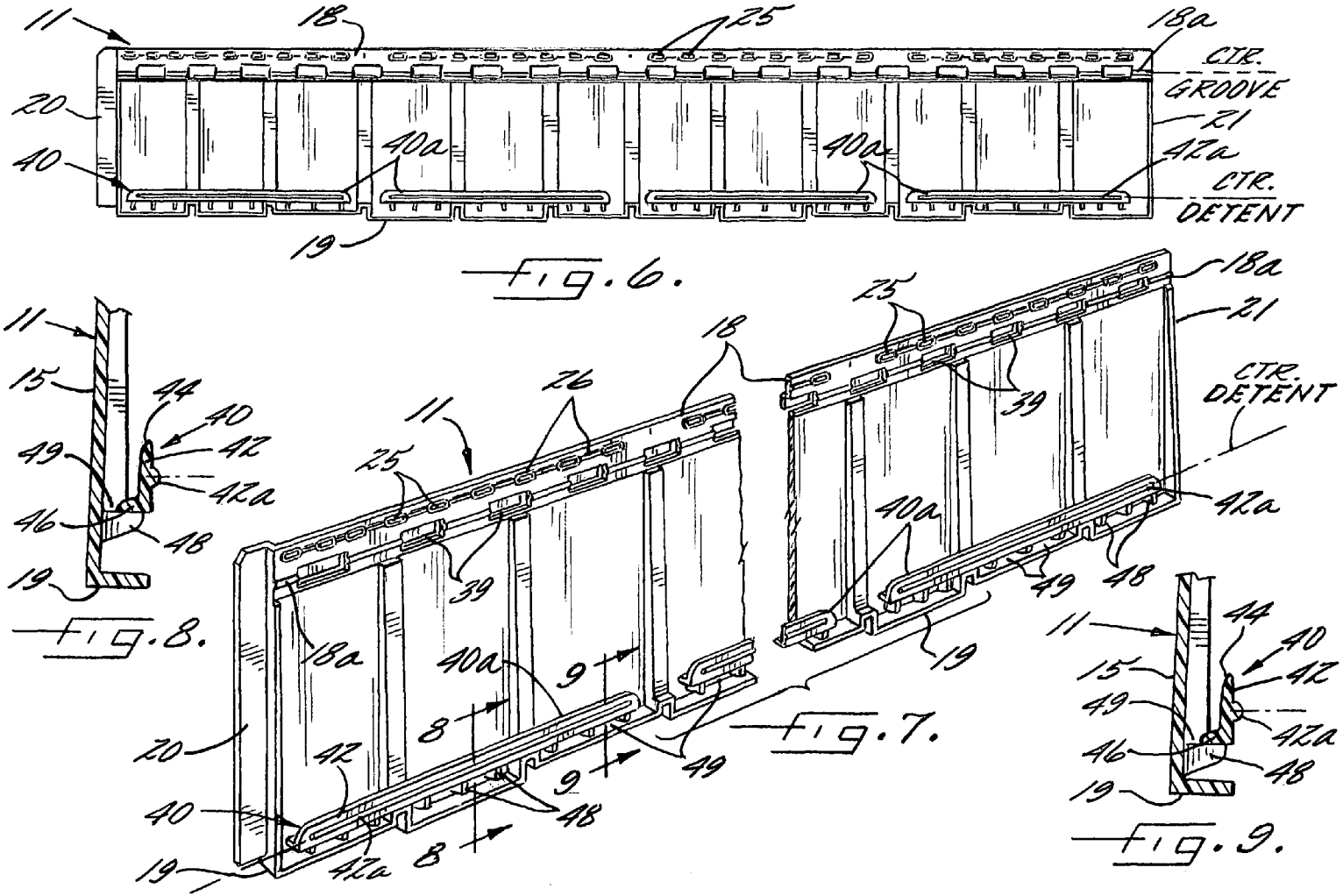
Figure 10:
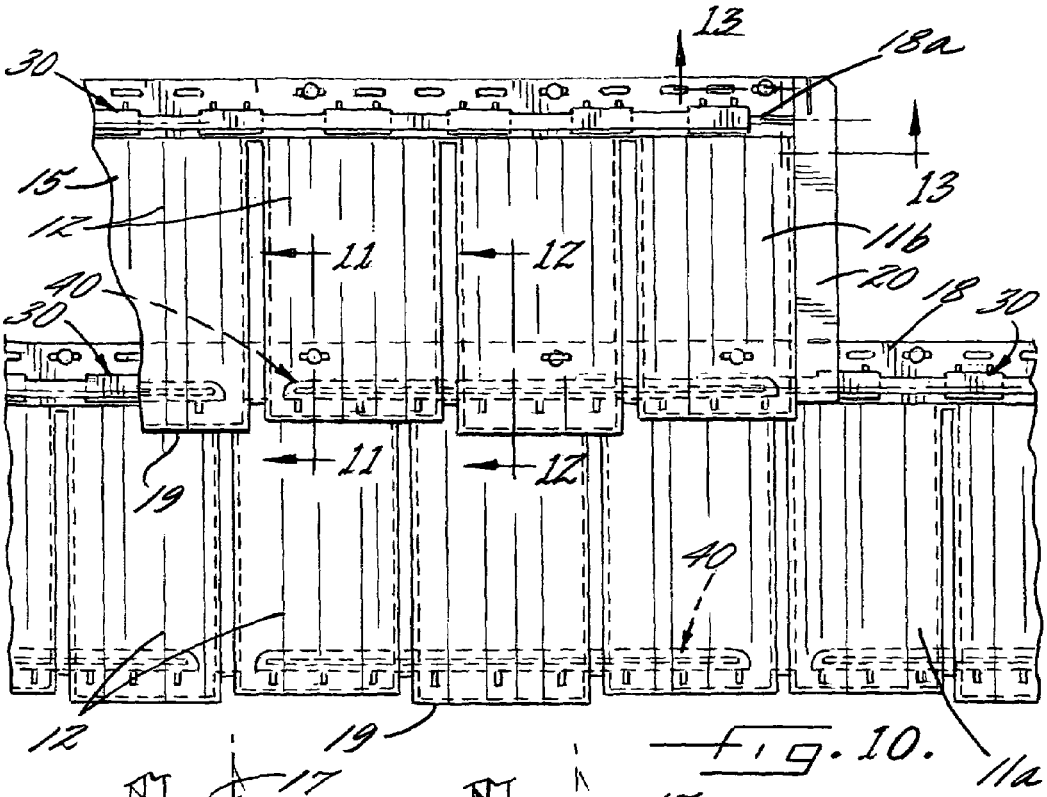
Figure 11:
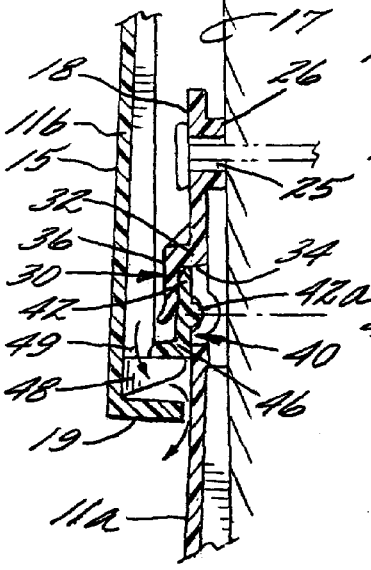
Figure 12:
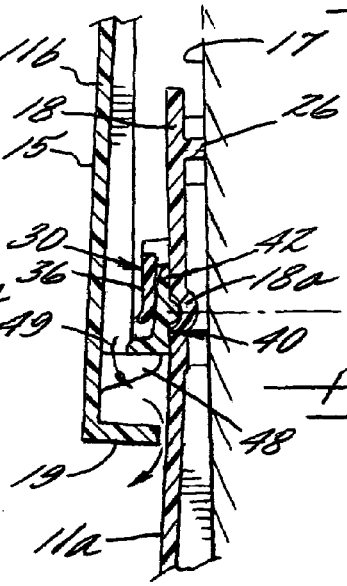
Figure 13:
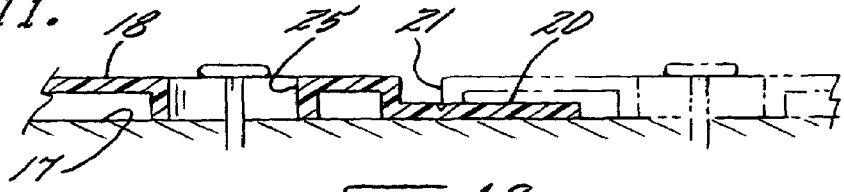

FIGS. 4 and 5 are enlarged fragmentary sections of the illustrative panel, taken in the planes of lines 4-4 and 5-5, respectively in FIG. 3;

FIG. 6 is a rear plan view of the panel shown in FIG. 2;

FIG. 7 is an enlarged rear perspective of the panel shown in FIG. 6;

FIGS. 8 and 9 are enlarged fragmentary sections of the illustrated panel taken in the planes of lines 8-8 and 9-9, respectively in FIG. 7;

FIG. 10 is a partial plan view showing two installed courses of the wall covering; and FIGS. 11-13 are enlarged fragmentary sections taken in the planes of lines 11-11, 12-12 and 13-13, respectively.

While the invention is susceptible of various modifications and alternative constructions, a certain illustrative embodiment thereof has been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

DETAILED DESCRIPTION OF THE INVENTION

Figure 1:
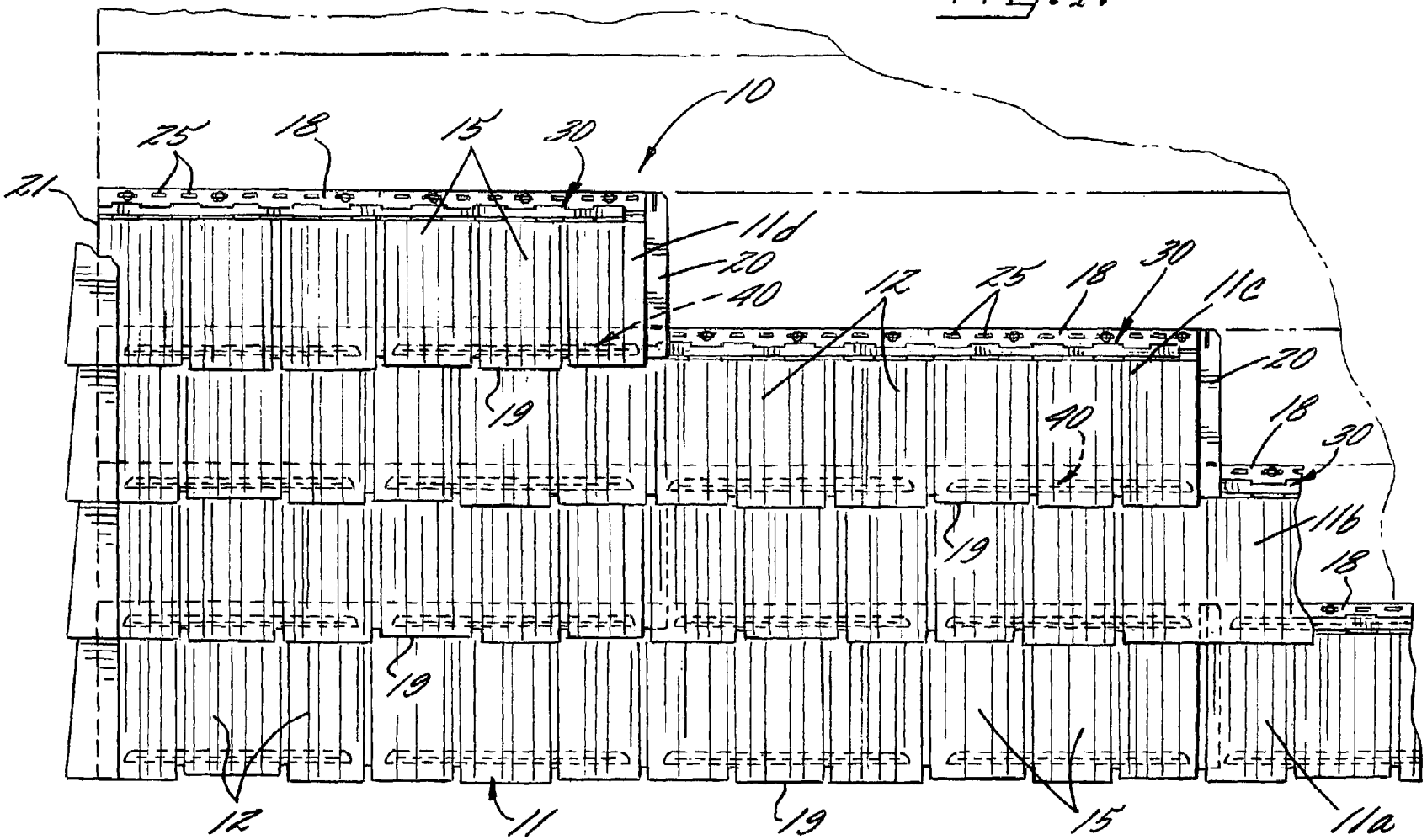
FIG. 1 is a plan view of a wall covering comprising panels constructed in accordance with the present invention.

Referring now more particularly to FIG. 1 of the drawings, there is shown an illustrative wall covering 10 comprising a plurality of plastic molded panels 11 in accordance with the present invention. The general type of panel employed in the instant invention is described in commonly assigned U.S. Pat. Nos. 5,347,784 and 5,537,792, the disclosures of which are incorporated herein by reference. As shown in FIG. 1, the panels 11 each are formed with simulated building elements. In this instance, the panels 11 are formed with simulated cedar shake shingles 12 of irregular width and length which are disposed in a single row substantially along the length of the panel.

The simulated shake shingles 12 in this case each have a front face 15 (FIG. 3) extending downwardly and outwardly at a slight taper to a wall or support surface 17 upon which the panel is mounted, and the front face 15 is molded with grooves which simulate the grain of the simulated shake 12. It will be understood that the panels 11 could be formed with other forms of simulated shake shingles, or other types of building materials, such as tile, brick and the like.

Each panel 11 has an upper horizontal marginal edge region 18 having a substantially uniform width extending across the top of the panel immediately above the row of shake 12, a lower marginal edge region 19 adjacent an irregular lower peripheral edge of the simulated shake, a side marginal edge region 20 in the form of a laterally-extending flange located to the right-hand side of the last simulated shake 12 in the row, and a marginal edge region 21 on the opposite side of the panel 11 defined by a left-side peripheral edge immediately adjacent the first simulated shake shingle 12 of the row. The panels 11 are mounted on a support surface 17, which may be a wall or roof of a house or other building structure, in horizontal courses with the right-side marginal edge region 20 in underlying relation to the left-side marginal edge region 21 of the panel immediately to the right thereof (as shown in FIG. 13) and with the lower marginal edge region 19 of the panels in each course overlying the upper marginal edge region 18 of the panel in the previously installed course immediately below. (see FIGS. 11-12)

The panels 11 typically are mounted beginning with the left-hand panel of the lowermost course to be installed on the wall or roof, as is known in the art. Upon completion of the first course, the second course is installed, immediately above the first course, again starting from the left-hand side. As is customary in the art, the left-hand marginal edge region of the first panel of each row may be appropriately cut square with the left side starting edge of the support surface. In the following description, when discussing the interaction of panels disposed in vertically displaced courses, the panels of the lower most course will be designated with the reference numeral "11*a*" and the panels of the subsequent courses will be designated with the reference numerals "11*b*", "11*c*" etc. This convention is employed in order to clarify the relative positions and order of installation of the subject panels.

For securing the panels 11 to the support surface 17, the upper marginal edge region 18 of each panel 11 is formed with a row of elongated laterally spaced nailing apertures 25. In order to provide firm support for the panel 11 on the wall during nailing and for establishing a seal between the rear side of the panel 11 and the support surface 17, the upper marginal edge region 18 in this instance is formed with rearwardly extending horizontal sealing flanges 26 which surround the nailing apertures and extend substantially the length of the upper marginal edge region 18 (FIG. 7). Once the upper marginal edge region 18 is nailed to the support surface, the horizontal sealing flanges 26 are maintained against the support surface 17.

In accordance with the invention, the panels have an interlock arrangement that enables reliable inter-engagement of overlying lower and upper marginal edge regions of the panels upon upward positionable movement of the overlying panel during installation and which facilitates efficient handling of the overlying panel while being secured to the support surface. To this end, the panels 11 each have a continuous upper interlock rail 30 that extends substantially the length of the panel in forwardly and downwardly directed relation to the upper marginal edge region 18 of the panel that is engageable by a lower upturned interlock rail 40 of an overlying panel, which enables reliable inter-engagement of the panels without the risk of missing individual locking fingers, as in the prior art. The illustrative upper interlock rail 30 comprises a continuous downwardly directed interlock flange 36 that extends substantially the entire length of the panel, which is supported by a plurality of longitudinally-spaced horizontal support plates 32 integrally formed with the upper marginal edge region and reinforced by corner joints 35. The horizontal support plates 32 in this case are located between the nailing apertures 25 and the upper edge of the row building elements 12. The upper interlock flange 36 is disposed a distance from the forward surface of the upper marginal edge region 18 for defining a locking flange receiving slot 37, and a lower terminal end 38 of the locking flange is flared outwardly for guiding the bottom interlock rail 40 of an overlying panel into engaging relation, as will become apparent. To facilitate molding of the continuous interlock rail 30 with the panel 11, the upper marginal edge region 18 in this instance is formed with a plurality of laterally-spaced generally rectangular openings 39 which allows tooling to protrude forwardly through the panel to form the locking flange 36. As will be understood by a person skilled in the art, this allows the upper interlock rail 30 to be integrally molded with the panel without the necessity for separate attachment, such as by welding.

The lower interlock rail 40, while also extending substantially the length of the panel, may comprise a single continuous rail or several relatively-long rail segments 40*a* as illustrated, which in this case each extend the width of about three of the simulated shake shingles 12. Each lower interlock rail segment 40*a* includes an upturned interlock flange 42 that is easily movable into continuous engaging relation with the interlock flange 36 of the upper rail 30. To facilitate such inter-engagement, an upper terminal end 44 of the lower interlock flange 42 is rounded to facilitate sliding, camming engagement with the downwardly-directed interlock flange 36 of the upper rail 30. It can be seen, therefore, that the interlock flanges 36, 42 of the upper and lower interlock rails 30, 40 can be easily moved into interlocking relation with each other without cumbersome manipulation of large numbers of small interlock fingers customary of the prior art.

In keeping with the invention, a cooperative detent arrangement is provided for further locating the interlock flanges 36, 42 in proper engaging relation to each other and for positively supporting the weight of the overlying panel for sufficient hang time as to enable the installer to secure the panel, such as by nailing or screwing, onto the support surface without manually supporting the weight of they overlying panel. To this end, a rearward face of the bottom interlock flange 42 is formed with a protruding detent 42*a* in the form of an elongated rounded nib that extends horizontally the length of each rail segment 40*a* and which is positionable with snap action engagement into a corresponding rounded detent recess 18*a* formed in the upper marginal edge region of the underlying panel which extends substantially the length of the panel. It will be understood by a person skilled in the art that the interlock flanges 36, 42 may be designed to forcefully urge the detents 42*a*, 18*a* into snap action inter-engaging relation with the each other as an incident to upward positioning of the overlying panel during installation. Since the detent nibs and recess 42*a*, 18*a* extend substantially the entire length of the panels sufficient frictional retention may be achieved to support the weight of the panel for the relatively short hang time necessary for enabling the installer to secure the overlying panel in mounted position. As used herein, the term "hang time" means the time the overlying panel will remain supported by the inter-engaging detents to enable securement of the panel to the support surface without the need for manually supporting the weight of the panel.

While the detents 42*a*, 18*a* serve both to preliminarily locate the overlying panel in aligned relation to the underlying panel during installation and support the panel during securement of the panel in mounted position, the rounded configuration of the detent nibs 42*a* and recess 18*a* enable the panel to be selectively slid into and out of engagement, such as may be necessary in allowing the installer to adjust the final position of the overlying panel. The configuration of detents 42*a*, 18*a* further accommodates relative movement of the panels from temperature expansion and contraction of the panels during usage. While in the illustrated embodiment the detent ribs 42*a* are formed on the rear lower interlock flange 42 and the detent recess 18*a* is formed on the front side in the upper marginal edge region 18 of the underlying panel, it will be understood that the reverse arrangement also could be used.

In further carrying out the invention, the interlock flange 42 of the lower interlock rail 40 is supported across a rear side of the row of simulated shake building elements 12 in a manner that does not capture water that might migrate between the panels, which facilitates air circulation through the wall covering following installation, and which does not detract from the natural appearance of the simulated building elements and the installed wall covering. In the illustrated embodiment, the lower interlock flange 42 is supported by a plurality of laterally-spaced vertical support plates 48 that extent outwardly from the rear side of the panel. The lower interlock flange 42 in this case has an L-shaped configuration for added structural rigidity, with a base 46 of the L-shaped flange 42 being integrally formed with the vertical support plates 48. The vertical support plates 48 in turn define a plurality of apertures 49 between the rear side of the panel and the interlock flange 42 which permit the free passage of any water that might migrate between the panels during severe weather conditions and which also facilitates the circulation of moisture laden air through the wall covering. Moreover, since the lower interlock flange 42 is supported entirely by the vertical plates 48, even if during plastic injection molding a faint line of the support plates 48 were visible from a front side of the panel, it will blend into the vertical graining of the simulated shake shingles 12 so as not to affect the aesthetic appearance of the installed wall covering.

It will be understood that the present invention has particular utility with panels which have a single row of simulated building elements, such as illustrated. Since such panels often are smaller and lighter in weight than panels which have a plurality of rows of building elements, smaller size detents may be utilized which are more readily releasable during adjustable positioning of an overlying panel during installation, as well as from movement during temperature expansion and contraction of the panels. With such single course panels being smaller in size, a multiplicity of panels also may be simultaneously molded in conventional sized molding equipment, with the panels having slightly different shingle patterns for providing a more varied and natural appearance of the finished wall covering.

In keeping with this aspect of the invention, in the preferred embodiment, the wall covering is formed with the panels in one course being formed with slightly different shingle patterns than the panels in the vertically-adjacent row. In the wall covering 10 shown in FIG. 1, for example, the panels 11*a* and 11*c* in the first and third courses may be identically formed and the panels 11*b* and 11*d* may be identically formed with slightly different characteristics of the simulated shake than the panels 11*a* and 11*c*. Panels with such a single row of simulated building elements have the further advantage that, upon installation, the individual rows the building elements of each panel physically overlap each other, which further enhances the natural appearance of the wall covering. Less wastage also is incurred with the use of panels with single row simulated building elements because the cutoff section of the panel that begins a course may be used at the opposite end thereof. Nevertheless, it will be understood that the invention also is applicable to panels which include a plurality of rows of simulated building elements.

From the foregoing, it can been seen that the roof and wall panels according to the invention have an interlock arrangement that is adapted for easier and more reliable installation. The continuous upper interlock rail facilitates substantially continuous interlocking engagement with a bottom interlock rail of an overlying panel without the cumbersome handling of numerous small interlock fingers which sometimes are missed during installation. The cooperating detent arrangement between the overlying lower and upper marginal edge regions of the panels further facilitates proper positioning of the overlying panel during installation, as well as supporting the weight of the panel sufficient to enable the installer to effect its securement on the support surface without cumbersome support of the weight of the panel. The bottom interlock flange further is supported transversely across a rear side of the row of simulated building elements in a manner which does not detract from the aesthetic appearance of the wall covering and which facilitates both liquid drainage and air circulation through the installed wall covering.

The invention claimed is:

1. The wall covering for mounting on a support surface comprising:

a plurality of panels each having a body portion formed with simulated building elements, said panels each having upper and lower marginal edge regions;

said panels being mountable on said support surface in a plurality of horizontal courses with said panels in a first horizontal course having a lower marginal edge region overlying an upper marginal edge region of a previously mounted panel in a second course positioned below the first horizontal course;

said upper marginal edge region of each panel having a continuous upper interlock flange positioned in forwardly and downwardly directed relation to the upper marginal edge region and extending substantially the length of the panel, said lower marginal edge region of each panel having at least one lower elongated interlock flange positioned in rearwardly and upwardly directed relation from a lower marginal edge region of the panel and disposed substantially the length of the panel;

said at least one lower interlock flange being engageable with said continuous upper interlock flange of the previously mounted panel in the second horizontal course as an incident to upward movement of the panel with respect to the previously mounted panel for positively securing together the overlying upper and lower marginal edge regions of the panels when mounted on the support surface; and said overlying upper and lower marginal edge regions having detents adapted for positive snap action engagement as an incident to engagement of said upper and lower interlock flanges upon upward movement of an overlying lower marginal edge region of a panel into a mounted position, said detents being disposed above a lower peripheral edge of the lower marginal edge region such that the overlying lower marginal edge region covers and hides the detents from viewing from a front side of the mounted panels;

in which said at least one lower interlock flange is supported by a plurality of laterally-spaced vertical plates integrally formed on a rear side of said panel which support the lower interlock flange in spaced relation to the rear side of the panel and which define air and liquid flow passages through said at least one lower interlock flange and along the rear side of the panel.

2. The wall covering of claim 1 in which said at least one lower interlock flange has an L-shaped cross section with a lower horizontal base portion being supported by said vertical support plates.

3. The wall covering of claim 1, wherein the upper marginal edge region of each panel includes a plurality of laterally-spaced openings to allow tooling to protrude through the panel for forming the continuous upper interlock flange.

4. The wall covering of claim 1 in which said at least one lower interlock flange of each panel comprises a plurality of elongated integrally aligned rail segments which each extends a transverse length greater than the width of two of the simulated building elements.

5. The wall covering of claim 1 in which said upper interlock flange has a lower terminal lip that flares outwardly with respect to said upper marginal edge region for guiding the at least one lower interlock flange of an overlying panel into engaging relation with the upper interlock flange.

6. The wall covering of claim 1 in which said upper interlock flange is substantially continuous and supported by a plurality of laterally-spaced support plates extending forwardly from said upper marginal edge region.

7. A wall covering for mounting on a support surface comprising:

a plurality of panels each having a body portion formed with simulated building elements; said panels each having upper and lower marginal edge regions;

said panels being mountable on said support surface in a plurality of horizontal courses with said panels in a first horizontal course having a lower marginal edge region overlying an upper marginal edge region of a previously mounted panel in a second course positioned below the first horizontal course, said upper marginal edge region of each panel having at least one upper elongated interlock flange positioned in forwardly and downwardly directed relation to the upper marginal edge region and disposed substantially the length of the panel, said lower marginal edge region of each panel having at least one lower elongated interlock flange positioned in rearwardly and upwardly directed relation from a lower marginal edge region of the panel and disposed substantially the length of the panel, said at least one lower interlock flange being engageable with said at least one upper interlock flange of a previously mounted panel in a second horizontal course as an incident to upward movement of the panel with respect to the previously-mounted panel for positively securing together the overlying upper and lower marginal edge regions of the panels when mounted on the support surface, and said at least one lower interlock flange being supported by a plurality of laterally spaced vertical plates integrally formed on a rear side of said panel which support the at least one lower interlock flange in spaced relation to a rear side of the panel and which define air and liquid flow passages between said at least one lower interlock flange and the rear side of the said panel.

8. The wall covering of claim 7 in which said at least one lower interlock flange has an L-shaped cross section with a lower horizontal base portion supported by said vertical support plates.

9. The wall covering of claim 7 in which said at least one lower interlock flange and said upper marginal edge region have detents adapted for snap action engagement as an incident to engagement of said upper and lower interlock flanges upon upward movement of the overlying panel in mounted position, said detents including a first detent element on a rear side of said at least one lower interlock flange and a second detent element on said upper marginal edge region of the panel opposite said at least one upper interlock flange, and said first and second detent elements are adapted for snap action engagement with sufficient retention force to support the weight of an overlying panel during securement to the wall surface.

10. The wall covering of claim 7, wherein the upper marginal edge region of each panel includes a plurality of laterally-spaced openings to allow tooling to protrude through the panel for forming the continuous upper interlock flange.

11. The wall covering of claim 7 in which said at least one lower interlock flange of each panel comprises a plurality of elongated integrally aligned rail segments which each extends a transverse length greater than the width of two of the simulated building elements.

12. The wall covering of claim 7 in which said upper interlock flange has a lower terminal lip that flares outwardly with respect to said upper marginal edge region for guiding the at least one lower interlock flange of an overlying panel into engaging relation with the upper interlock flange.

13. The wall covering of claim 7 in which said upper interlock flange is substantially continuous and supported by a plurality of laterally-spaced support plates extending forwardly from said upper marginal edge region.

* * * * *